US007146661B1

(12) United States Patent
Riehl

(10) Patent No.: US 7,146,661 B1
(45) Date of Patent: Dec. 12, 2006

(54) KNOCKDOWN, PORTABLE, NON-INTIMIDATING, AND STABLE PEN FOR COMFORTABLY, CONFORMINGLY, SUPPORTINGLY, AND ENTERTAININGLY ACCOMMODATING AN INFANT THEREIN

(76) Inventor: Christine Riehl, 60 Holly Dr., East Northport, NY (US) 11731

( * ) Notice: Subject to any disclaimer, the term of this patent is extended or adjusted under 35 U.S.C. 154(b) by 0 days.

(21) Appl. No.: 11/077,021

(22) Filed: Mar. 10, 2005

Related U.S. Application Data

(60) Provisional application No. 60/555,039, filed on Mar. 22, 2004.

(51) Int. Cl.
*A47D 13/06* (2006.01)

(52) U.S. Cl. ..... 5/93.1

(58) Field of Classification Search ..... 5/655, 5/93.1, 93.2, 94, 95, 97; 119/28.5; D6/333, D6/390, 391; D30/118
See application file for complete search history.

(56) References Cited

U.S. PATENT DOCUMENTS

| | | | | | |
|---|---|---|---|---|---|
| 909,453 | A | | 1/1909 | Pullman | |
| 1,711,127 | A | * | 4/1929 | Reinosky | 5/93.1 |
| 2,016,005 | A | * | 10/1935 | Giannasca | 119/28.5 |
| 3,137,870 | A | * | 6/1964 | Fink | 5/93.1 |
| 3,638,602 | A | * | 2/1972 | Carreno | 5/93.1 |
| 3,763,506 | A | * | 10/1973 | Szego | 5/93.1 |
| 3,833,946 | A | * | 9/1974 | Von Wimmersperg | 5/94 |
| 4,003,098 | A | * | 1/1977 | Fink | 5/93.1 |
| 4,080,675 | A | * | 3/1978 | Kanowsky et al. | 5/655.9 |
| 4,146,938 | A | * | 4/1979 | Shakas | 5/655 |
| 4,825,487 | A | * | 5/1989 | Eberl | 5/655 |
| 4,980,937 | A | | 1/1991 | Mason et al. | |
| 5,095,567 | A | | 3/1992 | Kenoyer | |
| 5,115,529 | A | | 5/1992 | White | |
| 5,261,134 | A | | 11/1993 | Matthews | |
| 5,409,411 | A | * | 4/1995 | Schrieber | 5/655 |
| 5,473,785 | A | * | 12/1995 | Lager et al. | 5/655 |
| 5,524,640 | A | * | 6/1996 | Lisak et al. | 5/655 |
| 5,566,413 | A | * | 10/1996 | Webb et al. | 5/655 |
| 5,778,465 | A | * | 7/1998 | Myers | 5/93.2 |
| 5,937,465 | A | * | 8/1999 | Carew et al. | 5/655 |
| D424,755 | S | * | 5/2000 | Black et al. | D30/118 |
| 6,119,288 | A | * | 9/2000 | Hendrickson | 5/97 |
| 6,224,152 | B1 | | 5/2001 | Hughes et al. | |
| 6,263,526 | B1 | * | 7/2001 | Tu | 5/655 |
| 6,354,665 | B1 | | 3/2002 | Ross | |
| 6,408,463 | B1 | * | 6/2002 | Palacio | 5/655 |
| 6,418,575 | B1 | * | 7/2002 | Cheng | 5/93.1 |
| 6,539,563 | B1 | * | 4/2003 | Hsia | 5/93.2 |
| 6,829,795 | B1 | * | 12/2004 | Labish | 5/655.9 |
| 6,912,743 | B1 | * | 7/2005 | Weil | 5/93.1 |

(Continued)

OTHER PUBLICATIONS

Michelle Lawson—Philadelphia, Mom Tip!, Parenting Magazine, Aug. 2004, p. 17.

(Continued)

*Primary Examiner*—Michael Safavi
(74) *Attorney, Agent, or Firm*—Bernard S. Hoffman

(57) ABSTRACT

A knockdown, portable, non-intimidating, and stable pen for comfortably, conformingly, supportingly, and entertainingly accommodating an infant therein. The pen includes a basket, cushioning, and a stabilizer. The basket accommodates the infant therein. The cushioning replaceably lines the basket to allow the pen to be knockdown and portable and comfortably conforms to the infant to provide support for the infant. The stabilizer replaceably encircles the basket to allow the pen to be knockdown and portable and provides stability to the pen by preventing the pen from tipping over with the infant therein.

19 Claims, 3 Drawing Sheets

U.S. PATENT DOCUMENTS

2003/0192119 A1* 10/2003 Verbovszky et al. ..... 5/94
2004/0019972 A1* 2/2004 Schecter et al. ..... 5/655.9
2004/0261174 A1* 12/2004 DeHart et al. ..... 5/93.1

OTHER PUBLICATIONS

Top 5 Toys (That Aren't Toys), Parents Magazine, May 2004, p. 18.
Veronica Haltner, Baby Basket, Parents, Nov. 2005, p. 269.

* cited by examiner

FIG. 3
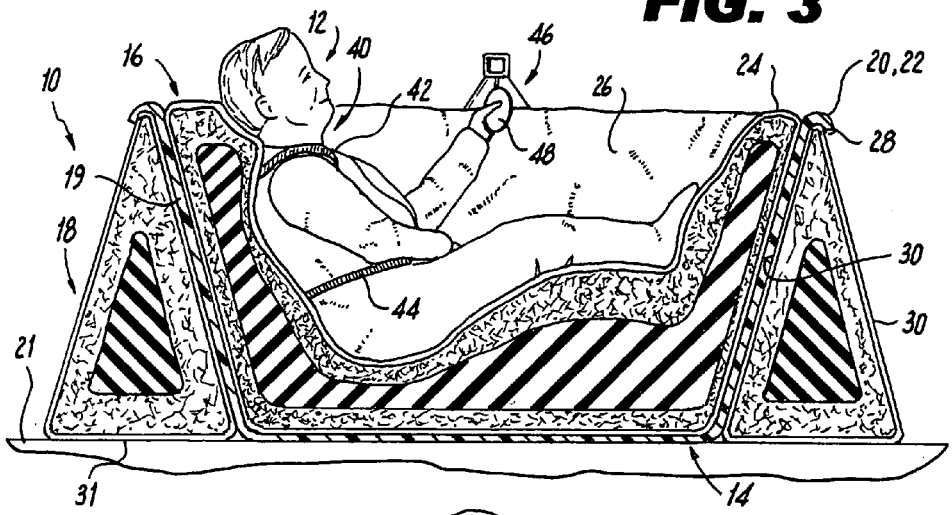
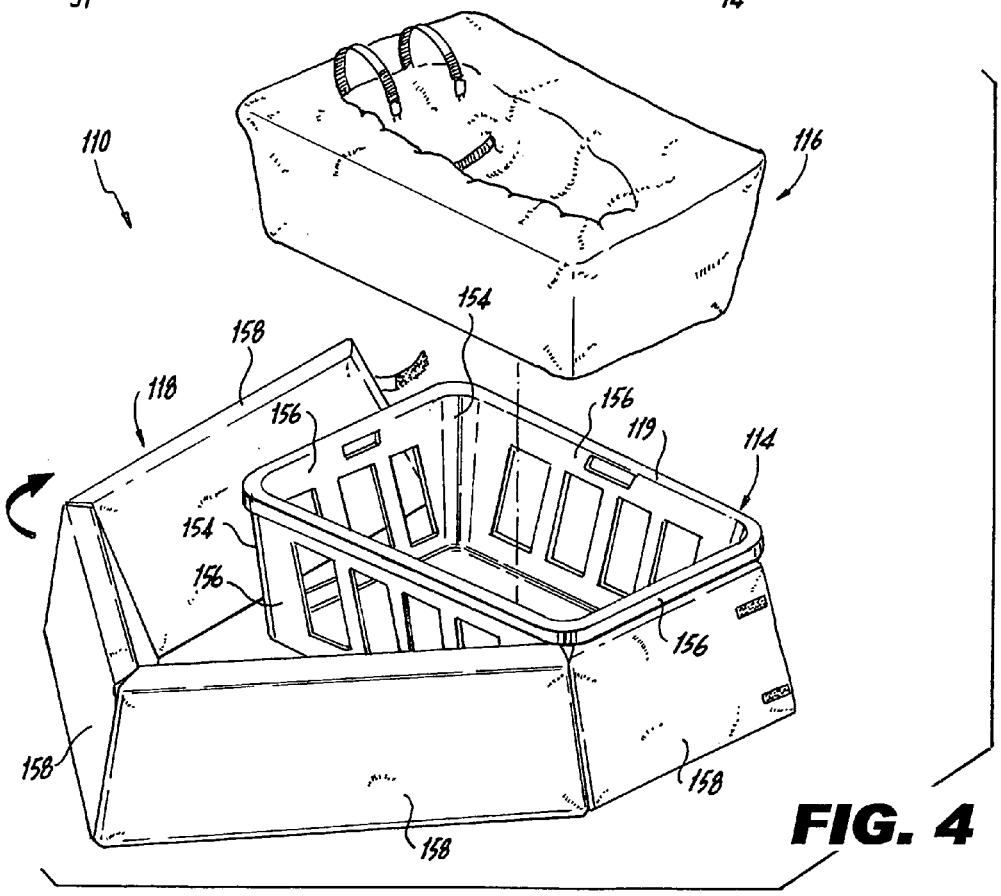
FIG. 4

KNOCKDOWN, PORTABLE, NON-INTIMIDATING, AND STABLE PEN FOR COMFORTABLY, CONFORMINGLY, SUPPORTINGLY, AND ENTERTAININGLY ACCOMMODATING AN INFANT THEREIN

CROSS REFERENCE TO RELATED APPLICATIONS

The instant application is a non-provisional application claiming priority from provisional application No. 60/555,039, filed Mar. 22, 2004, and entitled LEARN TO SIT (FOR BABIES).

BACKGROUND OF THE INVENTION

1. Field of the Invention

The present invention relates to a pen for an infant, and more particularly, the present invention relates to a knockdown, portable, non-intimidating, and stable pen for comfortably, conformingly, supportingly, and entertainingly accommodating an infant therein.

2. Description of the Prior Art

Playpens, enclosed structures in which a baby can be safely left alone to play, have been in use for decades. Traditional playpens include a square base and square walls. The base has a soft cushion for the baby's comfort and the walls are typically designed to keep the child inside. Although safe, traditional playpens do not look to be very appealing places to leave infants by themselves, owing to their cube-like shapes and sparse appearance.

Further, the somewhat large size of a playpen can prove to be quite intimidating to an infant left therein. Additionally, a playpen is not conforming to the infant and therefore cannot provide support therefor.

Thus, there exists a need for a knockdown, portable, non-intimidating, and stable pen for comfortably, conformingly, supportingly, and entertainingly accommodating an infant therein.

Numerous innovations for infant support devices have been provided in the prior art that will be described infra. Even though these innovations may be suitable for the specific individual purposes to which they address, however, they differ from the present invention in that they do not teach a knockdown, portable, non-intimidating, and stable pen for comfortably, conformingly, supportingly, and entertainingly accommodating an infant therein.

FOR EXAMPLE, U.S. Pat. No. 909,453 to Pullman teaches a back rest for children composed of any suitable material and trimmings that may be desired and of sufficient weight to remain stationary wherever placed and yet capable of being conveniently moved about.

ANOTHER EXAMPLE, U.S. Pat. No. 4,980,937 to Mason et al. teaches an infant sitting support and head protection ring for protecting the head of an infant that is trying to sit up, but is not yet strong enough. Included are a primary ring configured to conform to the shape of the buttocks, legs, and feet of a sitting infant, so that the infant is held snugly. The ring is made of a soft, yet supportive material. The ring also includes back and head support members provided integrally to the ring for supporting a sitting infant. The protection ring is configured, so that when an infant falls, its head falls upon the soft ring.

STILL ANOTHER EXAMPLE, U.S. Pat. No. 5,095,567 to Kenoyer teaches a wearable, light weight infant supporting device to aid in learning to sit. The device consists of a triangular cross section pillow-like back support and attaching straps for snugly securing the back support to the infant. The back support is placed at the rear of the seated infant, the straps are routed under the infant's legs, across the stomach, and fastened to the opposite end of the back support.

YET ANOTHER EXAMPLE, U.S. Pat. No. 5,115,529 to White teaches a support for selectively seating and protecting an infant, while developing balance and motor control in a seating position and which comprises a free standing support body having a substantially planar base, front, rear, and opposed side surfaces. The front surface includes a backrest portion, which is inclined at an acute angle with respect to the base, and spaced-apart side arms, which extend forwardly in the plane of the base from opposite sides of the front surface. The support body has sufficient weight and stability to inhibit movement or tipping of the support body. A seat cushion is independent of the support body and is attachable thereto in a first position and a second position. In the first position, the seat cushion combines with the support body to form a rearwardly inclined infant seat having a seat surface formed by a top surface of the seat cushion and a backrest surface formed by the backrest portion of the support body. In the second position, the seat cushion is remote from the backrest portion to provide a space enclosed at the rear by the backrest portion of the support body, at the sides by the opposed side arms, and at the front by the seat cushion. This space is adequate to accommodate an infant in a substantially unsupported sitting position for developing balance and motor control, while providing a surrounding cushion to help prevent injury due to a fall in any direction from a seating position within the surrounding cushion. The side arms may also be provided with touch and sound toys, which are either built into the support or firmly attachable thereto.

STILL YET ANOTHER EXAMPLE, U.S. Pat. No. 5,261,134 to Matthews teaches a portable pillow for support of an infant, toddler, or young child. The upper and lower surfaces are rounded, resulting in a generally tubular shape, tapered at the ends and curved in an oval so, that the tapered ends engage one another when the pillow is not in use. The pillow is generally concave with respect to a vertical axis of symmetry, and since the left and right sides are symmetrical, the infant body is provided with sufficient pressure and vertebral support that he or she is prevented from rolling over when placed in the center well of the device. The pillow also provides anatomically correct support along the vertebral column of a toddler or young child. This support is accomplished by firm, resilient padding, and thus minimizes vertebral strain for all ages.

YET STILL ANOTHER EXAMPLE, United States Patent Number U.S. Pat. No. 6,224,152 B1 to Hughes et al. teaches a support for a baby having a flap portion, a seat portion, and a handle portion. The flap portion has at least one pocket. A pair of cushion blocks is removably attached to the seat portion, one on each side of the baby. The seat portion has a central area between the cushion blocks, composed of a non-slip material. Straps are included for securing the baby in a shopping cart or other seat. A handle is preferably attached to the handle portion for carrying the support. The cushion blocks support a baby too young to sit up alone in a seated position. Since the cushion blocks are removably attached on two surfaces, the support can also be laid flat for use as a changing pad.

STILL YET ANOTHER EXAMPLE, United States Patent Number U.S. Pat. No. 6,354,665 B1 to Ross teaches an inflatable infant sitting support device which can be used from the earliest developmental stage of learning to sit upright by an infant or a younger developmentally delayed child, consisting of four inflatable pieces and one cushioned, non-inflatable piece, which acts as the seat bottom for the device. The primary inflatable piece is "U" or horseshoe shaped and is sealed to the top of the cushioned, non-inflatable piece. There is an elongated, rectangular inflatable piece acting as a support to keep the device from tapping over to the back and sealed to the bottom of the back of the curved section at the back of the primary inflatable piece. There is a crescent-shaped inflatable piece acting as a head and neck support and sealed to the top of the curved section at the back of the primary piece. The final inflatable piece is a detachable safety bar, which can be snapped across the top of the front of the device to stop an infant's fall forward and to give an infant or developmentally delayed child something to grasp and try to maintain balance, while still using and strengthening the muscles needed to sit upright without support. The entire chair is made out of vinyl or vinyl-type plastic material, so that the device is easy to wipe clean, as well as easy to deflate and fold into a small package to be stored or packed for travel.

It is apparent that numerous innovations for infant support devices have been provided in the prior art that are adapted to be used. Furthermore, even though these innovations may be suitable for the specific individual purposes to which they address, however, they would not be suitable for the purposes of the present invention as heretofore described, namely, a knockdown, portable, non-intimidating, and stable pen for comfortably, conformingly, supportingly, and entertainingly accommodating an infant therein.

SUMMARY OF THE INVENTION

ACCORDINGLY, AN OBJECT of the present invention is to provide a knockdown, portable, non-intimidating, and stable pen for comfortably, conformingly, supportingly, and entertainingly accommodating an infant therein that avoids the disadvantages of the prior art.

ANOTHER OBJECT of the present invention is to provide a knockdown, portable, non-intimidating, and stable pen for comfortably, conformingly, supportingly, and entertainingly accommodating an infant therein that is simple to use.

BRIEFLY STATED, ANOTHER OBJECT of the present invention is to provide a knockdown, portable, non-intimidating, and stable pen for comfortably, conformingly, supportingly, and entertainingly accommodating an infant therein. The pen includes a basket, cushioning, and a stabilizer. The basket accommodates the infant therein. The cushioning replaceably lines the basket to allow the pen to be knockdown and portable and comfortably conforms to the infant to provide support for the infant. The stabilizer replaceably encircles the basket to allow the pen to be knockdown and portable and provides stability to the pen by preventing the pen from tipping over with the infant therein.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 3 is an enlarged diagrammatic cross sectional view taken along LINE 3—3 in FIG. 1; and FIG. 4 is an exploded diagrammatic perspective view of a second embodiment of a generally rectilinear knockdown, portable, non-intimidating, and stable pen of the present invention.

LIST OF REFERENCE NUMERALS UTILIZED IN THE DRAWING

First Embodiment

Figure 1:
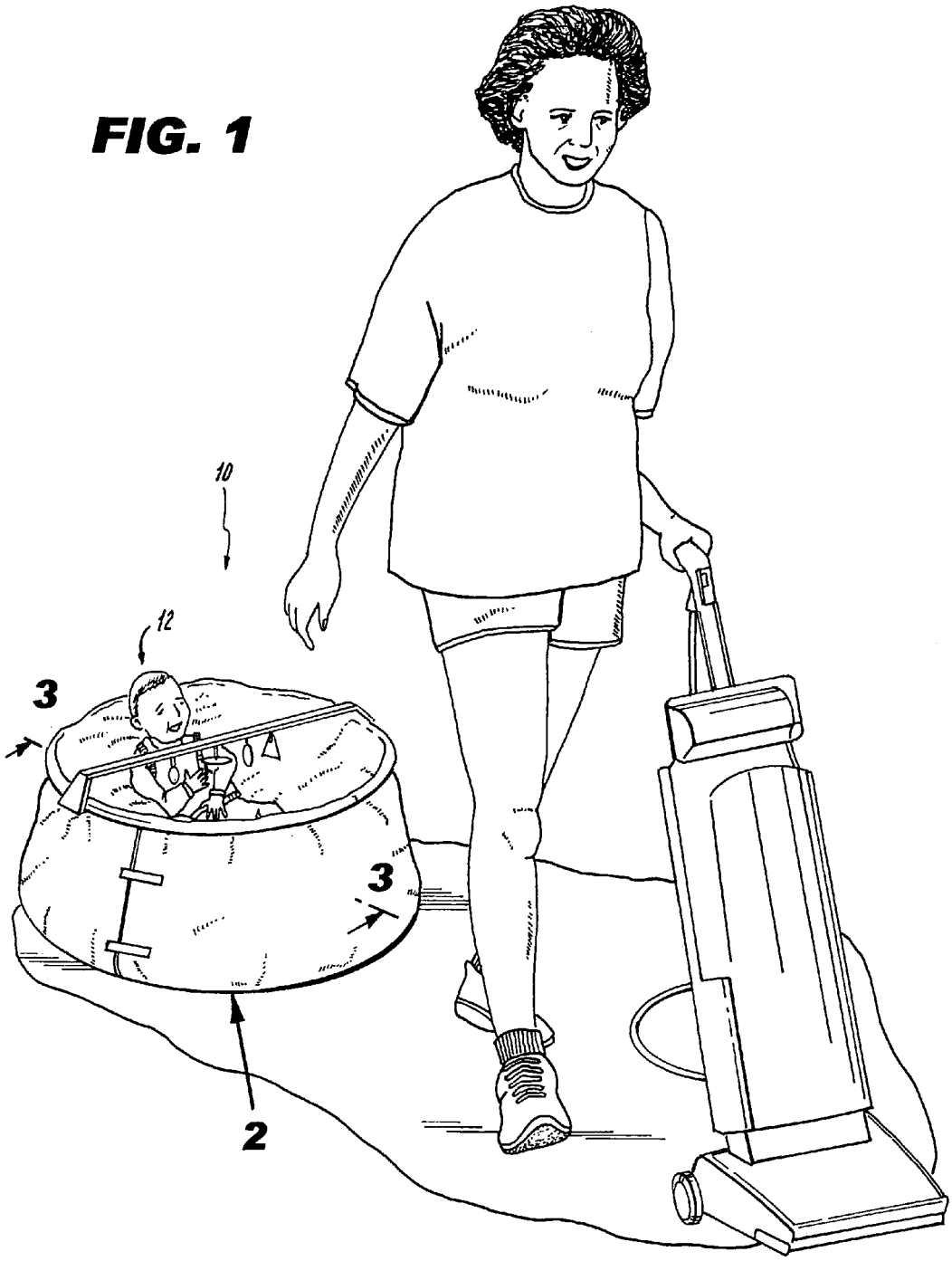
FIG. 1 is a diagrammatic perspective view of a first embodiment of a generally circular knockdown, portable, non-intimidating, and stable pen of the present invention comfortably, conformingly, supportively, and entertainingly accommodating an infant therein.

10 knockdown, portable, non-intimidating, and stable pen of present invention for comfortably, conformingly, supportingly, and entertainingly accommodating infant 12 therein

12 infant

14 basket for accommodating infant 12 therein and for resting on surface 21

16 cushioning for comfortably conforming to infant 12 so as provide support for infant 12

18 stabilizer

19 side wall of basket 14

20 upper boundary of side wall 19 of basket 14

21 surface on which basket 14 rests

22 circumferential lip of upper boundary 20 of side wall 19 of basket 14

24 upper surface of cushioning 16

26 depression in upper surface 24 of cushioning 16 for comfortably conforming to, and supporting, infant 12 therein

28 apex of stabilizer 18

30 pair of sides of stabilizer 18

31 base of stabilizer 18

32 pair of free ends of stabilizer 18

34 at least one strap on one free end of pair of free ends 32 of stabilizer 18

36 portion of hook and loop fasteners on at least one strap 34 on one free end of pair of free ends 32 of stabilizer 18

38 mating portion of hook and loop fasteners on other free end of pair of free ends 32 of stabilizer 18

40 harness of cushioning 16 for maintaining infant 12 in depression 26 in upper surface 24 of cushioning 16

42 pair of shoulder straps of harness 40 of cushioning 16

44 waist strap of harness 40 of cushioning 16

46 entertainment bar for providing entertainment for infant 12

48 suspended items of entertainment bar 46

50 pair of free ends of entertainment bar 46

52 pair of hooks of pair of free ends 50 of entertainment bar 46

Second Embodiment

110 knockdown, portable, non-intimidating, and stable pen
114 basket
116 cushioning
118 stabilizer
119 side wall of basket 114
154 corners of side wall 119 of basket 114
156 side walls of basket 114
158 portions of stabilizer 118

DETAILED DESCRIPTION OF THE INVENTION

Referring now to the figures, in which like numerals indicate like parts, and particularly to FIG. 1, which is a diagrammatic perspective view of a first embodiment of a generally circular knockdown, portable, non-intimidating, and stable pen of the present invention comfortably, conformingly, supportively, and entertainingly accommodating an infant therein, the knockdown, portable, non-intimidating, and stable pen of the present invention is shown generally at 10 for comfortably, conformingly, supportingly, and entertainingly accommodating an infant 12 therein.

Figure 2:
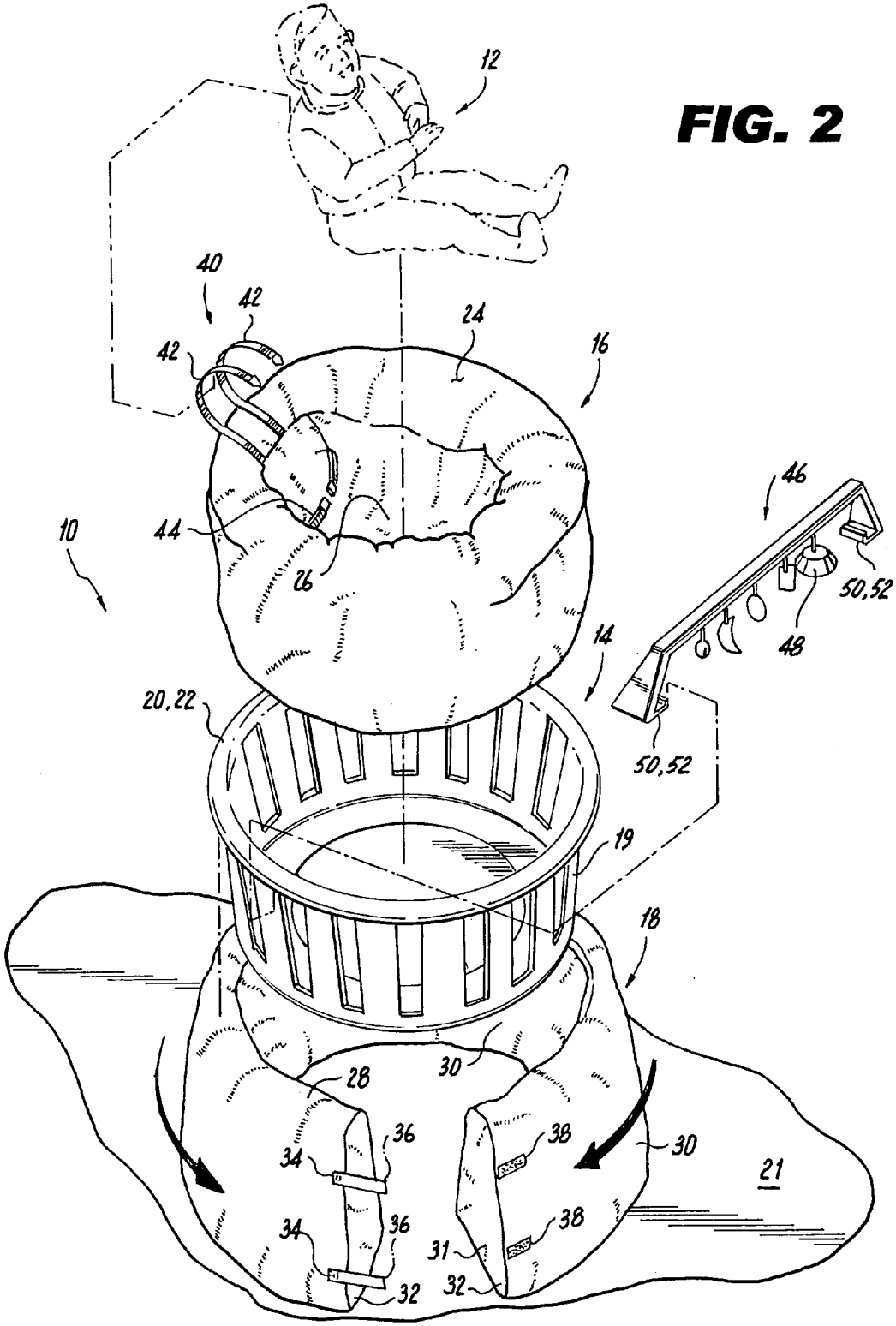
FIG. 2 is an enlarged exploded diagrammatic perspective view of the first embodiment of the generally circular knockdown, portable, non-intimidating, and stable pen of the present invention identified by ARROW 2 in FIG. 1.

The specific configuration of the knockdown, portable, non-intimidating, and stable pen 10 can best be seen in a FIGS. 2 and 3, which are, respectively, an enlarged exploded diagrammatic perspective view of the first embodiment of the generally circular knockdown, portable, non-intimidating, and stable pen of the present invention identified by ARROW 2 in FIG. 1 and an enlarged diagrammatic cross sectional view taken along LINE 3—3 in FIG. 1, and as such, will be discussed with reference thereto.

The knockdown, portable, non-intimidating, and stable pen 10 comprises a basket 14, cushioning 16, and a stabilizer 18. The basket 14 is for accommodating the infant 12 therein. The cushioning 16 replaceably lines the basket 14 to allow the pen 10 to be knockdown and portable and is for comfortably conforming to the infant 12 to provide support for the infant 12. The stabilizer 18 replaceably encircles the basket 14 to allow the pen 10 to be knockdown and portable and provides stability to the pen 10 by preventing the pen 10 from tipping over with the infant 12 therein.

Generally, the basket 14 can be any type of basket suitable for accommodating the infant 12 therein, and generally, can be made of any material suitable for this intended use, and generally, can be of any shape suitable for this intended use. Specifically, the basket 14 can be, but is not limited to, preferably a laundry basket or the like, and specifically, can be made of, but is not limited to, preferably plastic, straw, or the like, and specifically can be, but is not limited to, preferably generally circular, generally square, generally rectangular, etc. The first embodiment of the knockdown, portable, non-intimidating, and stable pen 10 includes a generally circular basket 14.

Generally, the cushioning 16 can be any type of cushioning for comfortably conforming to, and supporting, the infant 12, and generally, can be made out of any material suitable for this intended use, and generally, can be of any shape suitable for this intended use. Specifically, the cushioning 16 can be, but is not limited to, preferably a bolster, a cushion, or the like, and specifically, can be made out of a washable cushiony material that is soft, yet supportive, but is not limited to, preferably non-allergenic vinyl-covered foam rubber or the like, and specifically can be, but is not limited to, preferably generally circular, generally square, generally rectangular, etc. so along as it generally conforms to the basket 14.

Generally, the stabilizer 18 can be any type of stabilizer that provides stability to the pen 10 by preventing the pen 10 from tipping over with the infant 12 therein, and generally, can be made out of any material suitable for this intended use, and generally, can be of any shape suitable for this intended use. Specifically, the stabilizer 18 can be, but is not limited to, preferably a collar or the like, and specifically, can be made out of, but is not limited to, a washable cushiony material, but is not limited to, preferably non-allergenic vinyl-covered foam rubber or the like, and specifically can be, but is not limited to, preferably generally circular, generally square, generally rectangular, etc. so along as it generally conforms to the basket 14.

The basket 14 has a side wall 19 with an upper boundary 20 and is for resting on a surface 21. The side wall 19 of the basket 14 is downwardly tapering so as to have an incline. The upper boundary 20 of the side wall 19 of the basket 14 is formed into a circumferential lip 22. The circumferential lip 22 of the basket 14 is radially-outwardly extending and generally inverted U-shaped.

The cushioning 16 has an upper surface 24. The upper surface 24 of the cushioning 16 has a depression 26 therein. The depression 26 in the cushioning 16 is so configured for comfortably conforming to, and supporting, the infant 12 therein.

The stabilizer 18 is generally triangular-shaped in lateral cross section, and as a result thereof, has an apex 28, a pair of sides 30, and a base 31. The apex 28 of the stabilizer 18 is generally convex, and each side of the pair of sides 30 of the stabilizer 18 is downwardly diverging so as to have an incline. The incline of an inner side of the pair of sides 30 of the stabilizer 18 generally conforms to the incline of the side wall 19 of the basket 14.

The stabilizer 18 encircles the side wall 19 of the basket 14, with the apex 28 thereof replaceably captured in the circumferential lip 22 of the basket 14, with the inner side of the pair of sides 30 thereof abutting against the side wall 19 of the basket 14, and with the base 31 thereof contacting the surface 21 on which the basket 14 rests, and in so doing, a wide footprint is provided for the stabilizer 18, thereby preventing the pen 10 from tipping over with the infant 12 therein.

The stabilizer 18 can be either endless, in which case the basket 14 would slide down into it, or can have a pair of free ends 32, in which case the stabilizer 18 would wrap around the basket 14. In the latter case, the stabilizer 18 has at least one strap 34 that extends outwardly from one free end of the pair of free ends 32 thereof. The at least one strap 34 of the stabilizer 18 has a portion 36 of hook and loop fasteners thereon that selectively engages with a mating portion 38 of the hook and loop fasteners on the other free end of the pair of free ends 32 thereof, and when engaged therewith, the stabilizer 18 is maintained around the basket 14.

The cushioning 16 further has a harness 40. The harness 40 of the cushioning 16 is for maintaining the infant 12 in the depression 26 in the cushioning 16. The harness 40 of the cushioning 16 can include, but is not limited to, a pair of shoulder straps 42 and a waist strap 44.

The knockdown, portable, non-intimidating, and stable pen 10 further comprises an entertainment bar 46. The entertainment bar 46 is replaceably attached to the basket 14 to allow the pen 10 to be knockdown and portable and is for providing entertainment for the infant 12. The entertainment bar 46 can include, but is not limited to, preferably suspended items 48 or the like for moving by the infant 12.

The entertainment bar 46 has a pair of free ends 50. The pair of free ends 50 of the entertainment bar 46 are formed into a pair of hooks 52, respectively. Each hook of the pair of hooks 52 of the entertainment bar 46 is inwardly extending and generally J-shaped so as to replaceably engage with the circumferential lip 22 of the basket 14 to allow the pen 10 to be knockdown and portable.

A second embodiment of the knockdown, portable, non-intimidating, and stable pen 110 can best be seen in FIG. 4, which is an exploded diagrammatic perspective view of a second embodiment of a generally rectilinear knockdown, portable, non-intimidating, and stable pen of the present invention, and as such, will be discussed with reference thereto.

The knockdown, portable, non-intimidating, and stable pen 110 is similar to the knockdown, portable, non-intimidating, and stable pen 10, except that the basket 114 is generally square/generally rectangular instead of generally circular, and as such, the side wall 119 thereof has corners 154 that divide the side wall 119 thereof into side walls 156, and the cushioning 116 and the stabilizer 118 generally conform to the basket 114.

The cushioning 116 is similar, except for a change in shape from generally circular to generally square/generally rectangular, but the stabilizer 118 has a change in shape from generally circular to generally rectilinear, since it has to fold around the basket 114.

The stabilizer 118 is divided into portions 158 thereof that are generally rectilinear and generally conform in length to the side walls 156 of the basket 114, respectively. Adjacent portions 158 of the stabilizer 118 are hinged to each other to allow the stabilizer 118 to fold at the corners 154 of the basket 114 and encircle the basket 114.

It will be understood that each of the elements described supra, or two or more together, may also find a useful application in other types of constructions differing from the types described supra.

While the invention has been illustrated and described as embodied in a knockdown, portable, non-intimidating, and stable pen for comfortably, conformingly, supportingly, and entertainingly accommodating an infant therein, however, it is not limited to the details shown, since it will be understood that various omissions, modifications, substitutions, and changes in the forms and details of the assembly illustrated and its operation can be made by those skilled in the art without departing in any way from the spirit of the present invention.

Without further analysis, the foregoing will so fully reveal the gist of the present invention that others can by applying current knowledge readily adapt it for various applications without omitting features that from the standpoint of prior art fairly constitute characteristics of the generic or specific aspects of the present invention.

The invention claimed is:

1. A knockdown, portable, non-intimidating, and stable pen for comfortably, conformingly, supportingly, and entertainingly accommodating an infant therein, comprising:

a) a basket;

b) cushioning; and c) a stabilizer;

wherein said basket is for resting on a surface;

wherein said basket is for accommodating the infant therein;

wherein said cushioning replaceably lines said basket to allow said pen to be knockdown and portable;

wherein said cushioning is for comfortably conforming to the infant to provide support for the infant;

wherein said stabilizer replaceably encircles said basket to allow said pen to be knockdown and portable;

wherein said stabilizer provides stability to said pen by preventing said pen from tipping over with the infant therein;

wherein said stabilizer is made from a washable cushiony material;

wherein said stabilizer has a shape selected from the group consisting of generally circular, generally square, and generally rectangular; and wherein said stabilizer is made from non-allergenic vinyl-covered foam rubber.

2. The pen as defined in claim 1, wherein said basket is made from a material selected from the group consisting of plastic and straw; and wherein said basket has a shape selected from the group consisting of generally circular, generally square, and generally rectangular.

3. The pen as defined in claim 1, wherein said cushioning is made from a washable cushiony material;

wherein said washable cushiony material of said cushioning is soft, yet supportive; and wherein said cushioning has a shape selected from the group consisting of generally circular, generally square, and generally rectangular.

4. The pen as defined in claim 3, wherein said cushioning is made from non-allergenic vinyl-covered foam rubber.

5. The pen as defined in claim 1, wherein said cushioning has an upper surface;

wherein said upper surface of said cushioning has a depression therein;

wherein said depression in said cushioning is so configured for comfortably conforming to the infant therein; and wherein said depression in said cushioning is so configured for supporting the infant therein.

6. The pen as defined in claim 1, wherein said stabilizer is endless; and wherein said basket slides down into said stabilizer.

7. The pen as defined in claim 5, wherein said cushioning has a harness;

wherein said harness of said cushioning is for maintaining the infant in said depression in said cushioning.

8. The pen as defined in claim 7, wherein said harness of said cushioning includes a pair of shoulder straps; and wherein said harness of said cushioning includes a waist strap.

9. A knockdown, portable, non-intimidating, and stable pen for comfortably, conformingly, supportingly, and entertainingly accommodating an infant therein, comprising:

a) a basket;

b) cushioning; and c) a stabilizer;

wherein said basket is for resting on a surface;

wherein said basket is for accommodating the infant therein;

wherein said cushioning replaceably lines said basket to allow said pen to be knockdown and portable;

wherein said cushioning is for comfortably conforming to the infant to provide support for the infant;

wherein said stabilizer replaceably encircles said basket to allow said pen to be knockdown and portable;

wherein said stabilizer provides stability to said pen by preventing said pen from tipping over with the infant therein;

wherein said basket has a side wall;

wherein said side wall of said basket is downwardly tapering so as to have an incline;

wherein said side wall of said basket has an upper boundary;

wherein said upper boundary of said side wall of said basket is formed into a circumferential lip; and wherein said stabilizer is generally triangular-shaped in lateral cross section, and as a result thereof, has an apex, a pair of sides, and a base.

10. The pen as defined in claim 9, wherein said circumferential lip of said basket is radially-outwardly extending; and wherein said circumferential lip of said basket is generally inverted U-shaped.

11. The pen as defined in claim 9, wherein said apex of said stabilizer is generally convex;

wherein each side of said pair of sides of said stabilizer is downwardly diverging so as to have an incline; and wherein said incline of an inner side of said pair of sides of said stabilizer generally conforms to said incline of said side wall of said basket.

12. The pen as defined in claim 9, wherein said stabilizer encircles said side wall of said basket, with said apex thereof replaceably captured in said circumferential lip of said basket, with an inner side of said pair of sides thereof abutting against said side wall of said basket, and with said base thereof contacting the surface on which said basket rests, and in so doing, a wide footprint is provided for said stabilizer, thereby preventing said pen from tipping over with the infant therein.

13. The pen as defined in claim 9, further comprising an entertainment bar;

wherein said entertainment bar is replaceably attached to said basket to allow said pen to be knockdown and portable; and wherein said entertainment bar is for providing entertainment for the infant.

14. The pen as defined in claim 13, wherein said entertainment bar includes suspended items for moving by the infant.

15. The pen as defined in claim 13, wherein said entertainment bar has a pair of free ends;

wherein said pair of free ends of said entertainment bar are formed into a pair of hooks, respectively; and wherein said pair of hooks of said entertainment bar replaceably engage with said circumferential lip of said basket to allow said pen to be knockdown and portable.

16. The pen as defined in claim 15, wherein each hook of said pair of hooks of said entertainment bar is inwardly extending; and wherein each hook of said pair of hooks of said entertainment bar is generally J-shaped.

17. A knockdown, portable, non-intimidating, and stable pen for comfortably, conformingly, supportingly, and entertainingly accommodating an infant therein, comprising:

a) a basket;

b) cushioning; and c) a stabilizer;

wherein said basket is for resting on a surface;

wherein said basket is for accommodating the infant therein;

wherein said cushioning replaceably lines said basket to allow said pen to be knockdown and portable;

wherein said cushioning is for comfortably conforming to the infant to provide support for the infant;

wherein said stabilizer replaceably encircles said basket to allow said pen to be knockdown and portable;

wherein said stabilizer provides stability to said pen by preventing said pen from tipping over with the infant therein;

wherein said stabilizer has a pair of free ends;

wherein said stabilizer wraps around said basket;

wherein said stabilizer has at least one strap; and wherein said at least one strap of said stabilizer extends outwardly from one free end thereof.

18. The pen as defined in claim 17, wherein said at least one strap of said stabilizer has a portion of hook and loop fasteners thereon that selectively engages with a mating portion of said hook and loop fasteners on the other free end of said stabilizer, and when engaged therewith, said stabilizer is maintained around said basket.

19. A knockdown, portable, non-intimidating, and stable pen for comfortably, conformingly, supportingly, and entertainingly accommodating an infant therein, comprising:

a) a basket;

b) cushioning; and c) a stabilizer;

wherein said basket is for resting on a surface;

wherein said basket is for accommodating the infant therein;

wherein said cushioning replaceably lines said basket to allow said pen to be knockdown and portable;

wherein said cushioning is for comfortably conforming to the infant to provide support for the infant;

wherein said stabilizer replaceably encircles said basket to allow said pen to be knockdown and portable;

wherein said stabilizer provides stability to said pen by preventing said pen from tipping over with the infant therein;

wherein said basket has a side wall;

wherein said side wall of said basket is downwardly tapering so as to have an incline;

wherein said side wall of said basket has corners;

wherein said corners of said basket divide said side wall thereof into side walls;

wherein said stabilizer is divided into portions;

wherein said portions of said stabilizer generally conform in length to said side walls of said basket, respectively; and wherein adjacent portions of said stabilizer are hinged to each other to allow said stabilizer to fold at said corners of said basket and encircle said basket.

* * * * *